US005663881A

United States Patent [19]

Cook, Jr.

[11] Patent Number: 5,663,881

[45] Date of Patent: Sep. 2, 1997

[54] ELECTRONIC CALIBRATED FUEL RAIL

[75] Inventor: Charles R. Cook, Jr., Rochester Hills, Mich.

[73] Assignee: Siemens Automotive L.P., Auburn Hills, Mich.

[21] Appl. No.: 740,785

[22] Filed: Aug. 6, 1991

[51] Int. Cl.[6] ..... G06G 7/70; F02D 41/00

[52] U.S. Cl. ..... 701/104; 123/470; 123/456; 123/696; 123/446; 239/600; 701/103; 701/102; 701/115

[58] Field of Search ..... 364/431.05, 431.03, 364/431.04, 431.051, 431.052, 431.053, 431.11, 431.12; 123/458, 446, 444, 470, 456, 468, 447, 502, 696, 491, 445; 239/600, 88

[56] References Cited

U.S. PATENT DOCUMENTS

| | | | |
|---|---|---|---|
| 4,307,450 | 12/1981 | Carp et al. | 364/431.05 |
| 4,422,424 | 12/1983 | Luscomb | 123/458 |
| 4,836,246 | 6/1989 | Lemp | 137/561 A |
| 4,844,036 | 7/1989 | Bassler et al. | 123/470 |
| 4,950,171 | 8/1990 | Muzslay | 123/456 |
| 5,042,445 | 8/1991 | Peters et al. | 123/500 |
| 5,117,794 | 6/1992 | Leshner et al. | 123/444 |

*Primary Examiner*—Jacques Louis-Jacques
*Attorney, Agent, or Firm*—Russel C. Wells

[57] ABSTRACT

The electronics are self-contained within the fuel rail assembly and include a microprocessor-based arrangement for enabling the fuel rail assembly to be dynamically calibrated over its full operating range at the factory and to be subsequently operated by serial data transmitted to it from the engine management computer.

5 Claims, 3 Drawing Sheets

ELECTRONIC CALIBRATED FUEL RAIL

REFERENCE TO A RELATED APPLICATION

Reference is made to the co-pending, commonly assigned application of Paul D. Daly entitled "Fuel Rail Assembly Having Self-Contained Electronics" now U.S. Pat. No. 5,178,115.

FIELD OF THE INVENTION

This invention relates to internal combustion engine fuel rails.

BACKGROUND AND SUMMARY OF THE INVENTION

The above referenced patent application discloses a fuel rail assembly in which internal electronic circuitry provides dynamic flow calibration. That circuitry is programmed during the process of making the fuel rail assembly, and thereafter it serves to operate the fuel injectors in the fuel rail assembly from electric power and signal inputs to the fuel rail assembly.

The present invention relates to the implementation of such circuitry in a fuel rail assembly.

Further details, advantages, and benefits will be seen in the ensuing description and claims which should be considered in conjunction with accompanying drawings illustrating a presently preferred embodiment of the invention according to the best mode contemplated at this time for carrying out the invention.

DESCRIPTION OF THE PREFERRED EMBODIMENT

Figure 1:
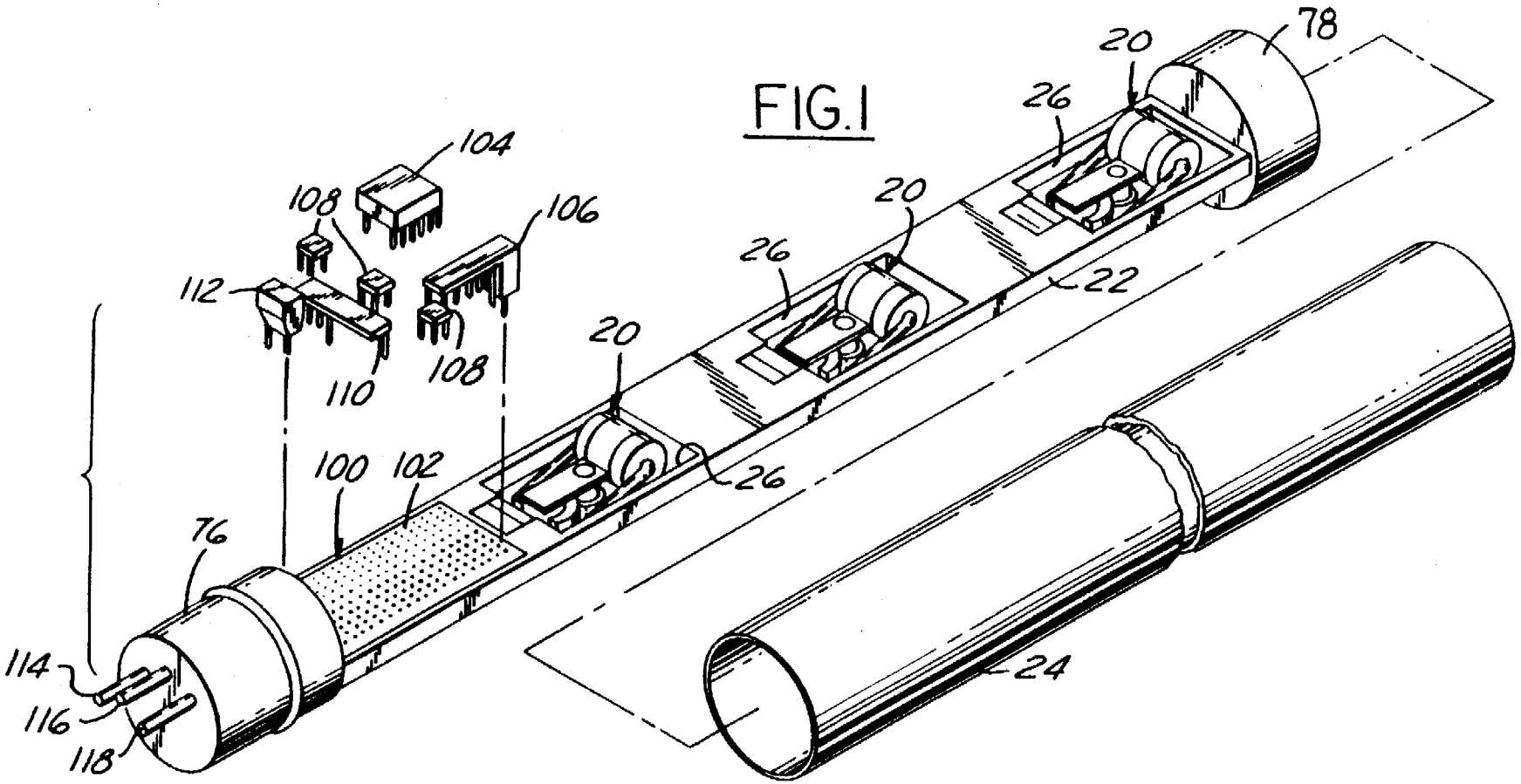
FIG. 1 is an exploded perspective view, with portions broken away for illustrative purposes, of a fuel rail assembly embodying principles of the invention.

FIG. 1 shows a fuel rail assembly having several fuel injectors 20 disposed in respective wells, or cavities, 26 of a carrier 22. Also disposed on carrier 22 between the set of fuel injectors 20 and connector 76 is an electronic circuit board assembly 100 which comprises a board 102 and several electronic devices, shown in the Fig. in exploded form for illustrative purposes. The several electronic devices are mounted on board 102 and interconnected by circuit paths on the board to provide the fuel rail assembly with self-contained electronics between a connector and closure member 76 at one end and fuel injectors 20. The carrier is disposed within a tube 24 such that the ends of the tube are closed by member 76 and by a closure 78 at the opposite end. There are holes in the tube wall for the injectors' nozzles so that fuel can be sprayed from the fuel rail assembly at the location of each injector and into a corresponding portion the engine's induction system for entrainment with induction air to form a combustible mixture that is subsequently ignited in the engine's combustion chambers to power the engine. Pressurized liquid fuel is introduced into the fuel rail via a nipple (not shown), but which may be in one of the end closures 76, 78. The fuel immerses the carrier, circuit board assembly, and fuel injectors. When the solenoid of each injector is energized by electric current delivers from the circuitry on the circuit board assembly, it opens to inject fuel from its nozzle.

The several electronic devices on the circuit board are a microprocessor 104 with associated crystal 106, fuel injector drivers 108, a PROM 110, and a voltage regulator 112. Connector 76 comprises three terminals 114, 116, 118. DC electric power (+V volts referenced to Ground) is delivered through a first (+V) and a second (Ground) of these terminals to the self-contained electronics, and voltage regulator 112 converts the delivered power to regulated DC level for microprocessor 104 and drivers 108. Principal command signals (referenced to ground) delivered by the engine management computer (not shown) to the fuel rail assembly pass through the third terminal (Signal) to a serial input port of microprocessor 104. The microprocessor output ports are connected to inputs of the respective drivers via the board, and the drivers' outputs are connected by respective conductors extending from the board along the carrier to the respective fuel injectors. The microprocessor acts on the principal command signals to produce corresponding operation of the fuel injectors. In other words, the principal command signals received by the self-contained electronics represent the pulse widths of signals that should cause the fuel injectors to deliver corresponding injections of fuel into their respective portions of the engine's induction system. Because of the electronic calibration that has been performed on the fuel rail assembly during its manufacturing process (such procedure to be subsequently explained), such correspondence is assured despite the presence of certain differences in the operating characteristics of different components.

For example, each fuel injector may have a slightly different dynamic flow characteristic due to manufacturing tolerances, and in such case each fuel injector will inject a slightly different amount of fuel from the others for identical command signals applied to them. With the ability to perform calibration of the self-contained electronics in accordance with one aspect of this invention, it becomes possible to compensate for these differences so that the fuel injections will more closely match one another. While it is typical practice to secure such closely matching correspondence between all injectors, the circuitry could, if desired, be constructed and arranged to provide for any particular fuel injector to be dynamically calibrated to any particular dynamic flow.

The dynamic flow calibration is performed in a test and calibration fixture (not shown) by a test and calibration machine (not shown) after the carrier/fuel injector/electronics sub-assembly has been assembled into tube 24. Pressurized liquid, which may be fuel or another fluid whose flow characteristics bear a known relationship to those of fuel, is supplied to fill the interior of the fixtured fuel rail assembly. The fuel injectors are operated by signals delivered through connector 76 and the fuel injections are measured. For example, signals can be applied at predetermined frequencies and pulse widths which should cause the injectors to deliver certain quantities of fuel. The actual quantities which the fuel injectors deliver in response to these signals are measured using a known "gravimetric" or volume means. If a fuel injector does not produce the intended volume, the difference is computed, and an error number, either positive or negative, is derived from that difference and entered into prom 110 by conventional prom programming techniques to create a correction factor within the fuel rail assembly's self-contained electronics. Microprocessor 104 will act upon this correction factor when it receives a principal command signal via connector 76 from the engine management computer and in consequence cause the corresponding fuel injector to deliver a quantity of fuel that agrees with that commanded by the principal command signal.

Figure 2:
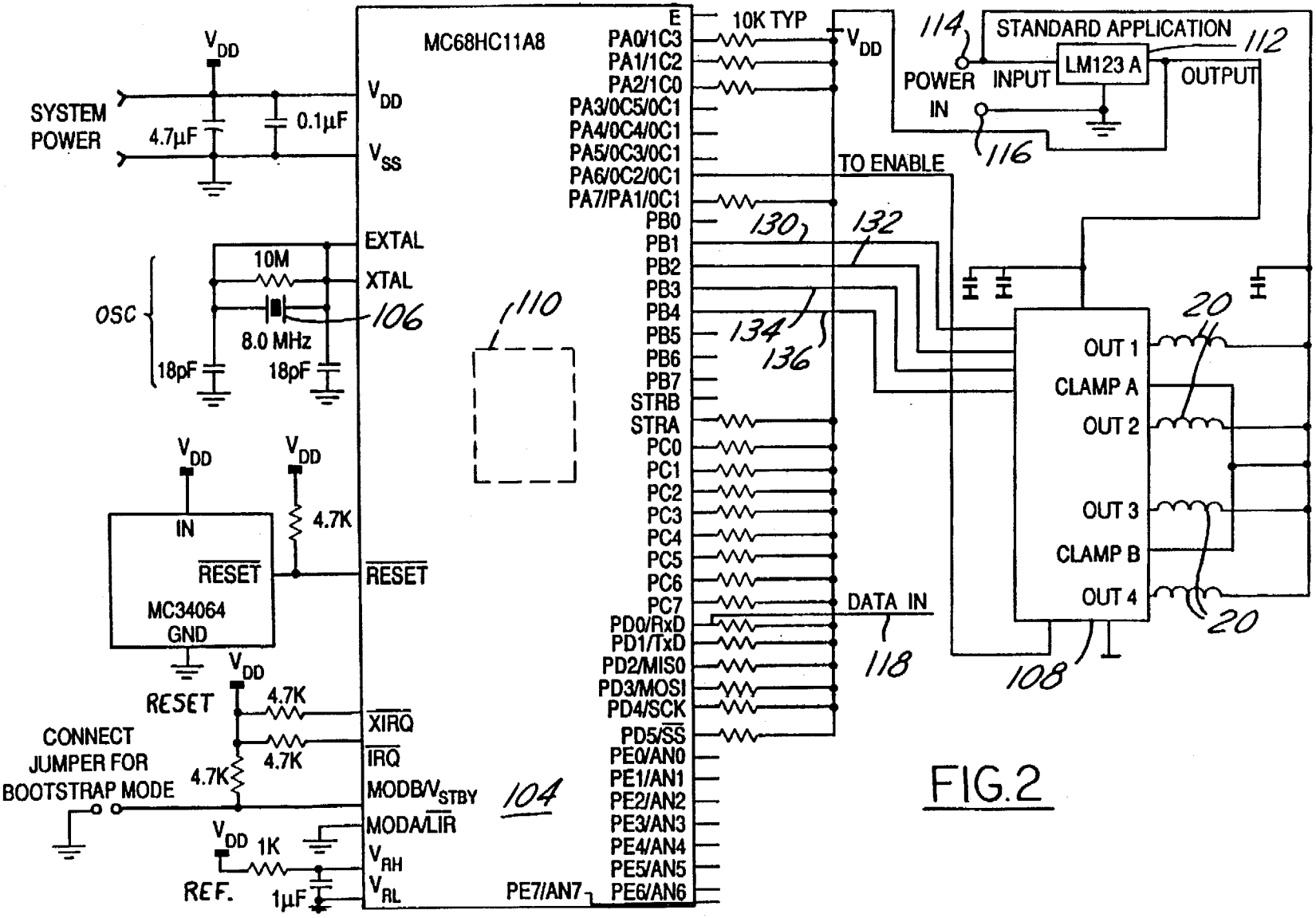
FIG. 2 is a schematic diagram of electronic circuitry contained in the fuel rail assembly.

FIG. 2 shows a schematic diagram. In this instance the prom 110 is contained internally of the microprocessor 104 and is in fact an EEprom. There are four fuel injectors and a single driver chip which contains all of the drivers 108.

Power is delivered via terminals 114, 116, and signals via terminal 118. Terminal 118 connects to a serial data input port of microprocessor 104. Each of four outputs 130, 132, 134, 136 of the microprocessor connects to a corresponding driver 108; each driver output, to a corresponding fuel injector 20. The digital signal input to the fuel rail at terminal 118 is in serial form.

Figure 3:
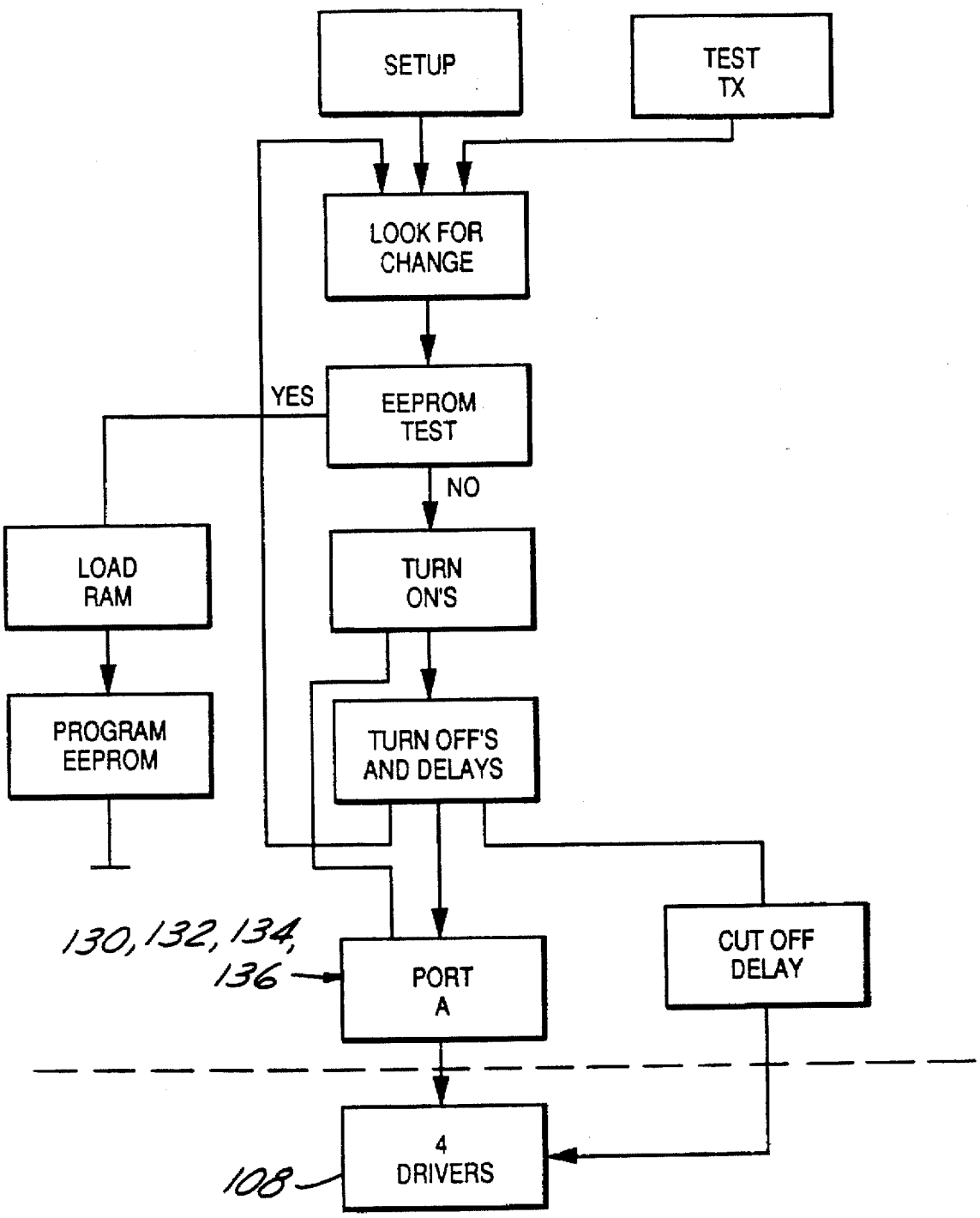
FIG. 3 is a generalized flow diagram useful in explaining the operation of the electronic circuitry.

There are two selectable modes of operation that are represented by the flow chart of FIG. 3. The first is a calibration mode for performing dynamic flow calibration in the manner described above. The second is the operational mode that occurs after the calibrated fuel rail assembly has been installed on the engine.

At the setup step, the correction numbers that were determined during the calibration process are entered into the EEprom. A particular bit of a particular input word designates if the formatted block of data that is to follow contains information about the correction numbers or about operation of the fuel injectors. The step "Look For Change" means that the microprocessor is looking for a change in the location of that particular bit so that the following block of data will be properly processed by the microprocessor. If the microprocessor determines that the data block is correction data, as will be the case during entry of the calibration data, then the step "EEprom Test" will answer "yes". This will result in the data being loaded into RAM (within the microprocessor) and subsequently stored in the EEprom, as represented by the steps "Load Ram" and "Program EEprom". Once that has been accomplished, the calibration is complete and the fuel rail assembly can be shipped from the factory for subsequent installation and use in an engine.

Operation of the fuel injectors is selectively controlled by different word bits, such as by using a particular bit to represent a particular fuel injector. The data block that follows a particular fuel injector bit designates the pulse width for which the fuel injector solenoid should be energized. The microprocessor functions to apply the particular correction factor for that particular injector to the command signal so that a corrected command signal is actually applied from the microprocessor to the corresponding driver. The steps entitled "Turn On's" and "Turn Off's" represent the microprocessor issuing commands to turn on and off the drivers. There is a step entitled "Cut Off Delay" which is used to force the injectors off if a turn off signal is not received within a predetermined maximum time limit from turn on.

In an exemplary embodiment, Bit number 1 of the incoming word always represents the status of injector number 1; bit number 2, injector number 2; etc. A "one" in bit number 5 causes a branch of the flow diagram to program a delay loop for each injector into the EEprom, but as already explained, this occurs only during the calibration process. In the step "Look for Change" the input register looks for any change since the last input byte. This is a 10 microsecond loop. All injectors are turned on without delay when the turn on command is received. They are turned off at particular times based on the correction factor for each. If two turnoffs should happen to occur on the same word, they would both be delayed the same amount. The outputs are latched and are updated each time a new word is processed. If no new turnons arrive within 0.5 seconds, all injectors are inhibited until the next turnon arrives.

The microprocessor is programmed in accordance with conventional programming techniques to implement the foregoing modes of operation. A suitable microprocessor is a 68HC11 8-bit device. Suitable drivers are L6221 devices. While a presently preferred embodiment has been disclosed, it should be appreciated that principles are applicable to other embodiments.

What is claimed is:

1. A fuel rail assembly for an internal combustion engine, said fuel rail assembly comprising self-contained electronics including a microprocessor which receives input signals for said fuel rail assembly in serial data form and which acts upon said input signals to apply thereto correction factors previously programmed into said self-contained electronics to thereby create corrected signals that are applied to fuel injectors of said fuel rail assembly to cause said fuel injectors of said fuel rail assembly to be turned on and off by said corrected signals with greater accuracy than would be the case without the use of said correction factors, said fuel rail assembly having a pair of terminals via which said self-contained electronics receives electric DC power for itself and said fuel injectors, and a third terminal via which said input signals are received by said self-contained electronics, said self-contained electronics including injector drivers that drive said fuel injectors in accordance with said corrected signals from said microprocessor.

2. A fuel rail assembly as set forth in claim 1 in which said correction factors were previously programmed into said self-contained electronics also via said third terminal.

3. A fuel rail assembly for an internal combustion engine, said fuel rail assembly comprising self-contained electronics including a microprocessor which receives input command signals for turning fuel injectors of said fuel rail assembly on and off and correction data signals which represent correction factors for said input command signals to thereby create corrected command signals that are applied to said fuel injectors to cause said fuel injectors of said fuel rail assembly to be turned on and off by said corrected command signals with greater accuracy than would be the case without the use of said correction factors, said fuel rail assembly having terminals via which said self-contained electronics receives electric DC power for itself and said fuel injectors and via which said input command signals and said correction data signals are received by said self-contained electronics, said self-contained electronics including injector drivers that drive said fuel injectors in accordance with said corrected command signals from said microprocessor.

4. A fuel rail assembly for an internal combustion engine comprising fuel injectors and self-contained electronics including a microprocessor which receives input signals for the fuel rail in serial data form representing a calculated fuel injection amount, and which acts upon that data to apply correction factors previously programmed into the electronics, said correction factors representing data individually adjusted to each injector's characteristics, said fuel rail having a pair of terminals via which the self-contained electronics receives electric DC power for itself and the fuel injectors, and a third terminal via which the input signals are received by the self-contained electronics, said electronics including injector drivers that drive said injectors in accordance with signals from the microprocessor.

5. A fuel rail assembly as set forth in claim 1 in which said correction factors were previously programmed into said electronics also via said third terminal.

* * * * *